US010840617B2

(12) United States Patent
Yoshida

(10) Patent No.: US 10,840,617 B2
(45) Date of Patent: Nov. 17, 2020

(54) ELECTRONIC DEVICE

(71) Applicant: FANUC CORPORATION, Yamanashi (JP)

(72) Inventor: Munehiko Yoshida, Yamanashi-ken (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 16/511,158

(22) Filed: Jul. 15, 2019

(65) Prior Publication Data

US 2020/0028286 A1 Jan. 23, 2020

(30) Foreign Application Priority Data

Jul. 20, 2018 (JP) ..... 2018-136461

(51) Int. Cl.
*H01R 12/00* (2006.01)
*H01R 12/51* (2011.01)
*H01R 9/24* (2006.01)

(52) U.S. Cl.
CPC ..... *H01R 12/515* (2013.01); *H01R 9/2416* (2013.01)

(58) Field of Classification Search
CPC . H01R 12/515; H01R 9/2416; H01R 13/6485
USPC ..... 439/76.1, 711
See application file for complete search history.

(56) References Cited

U.S. PATENT DOCUMENTS 6,074,242 A * 6/2000 Stefaniu ..... H01R 4/4827 439/441
6,948,949 B1 * 9/2005 Schwartz ..... H01R 9/2491 439/638
7,438,587 B2 * 10/2008 Germani ..... H01R 4/4836 439/441
9,640,878 B2 * 5/2017 Mestars ..... H01R 4/4836
2001/0053625 A1 * 12/2001 Vo ..... H01R 4/2433 439/409
2003/0119343 A1 * 6/2003 Lin ..... H01R 13/6658 439/76.1
2005/0112915 A1 * 5/2005 Mueller ..... H01R 4/4845 439/76.1
2012/0077365 A1 * 3/2012 Kobayashi ..... H01R 13/4223 439/345
2014/0134892 A1 * 5/2014 Wendt ..... H01R 4/5008 439/709

(Continued)

FOREIGN PATENT DOCUMENTS

JP 59025166 2/1984
JP H05-152031 A 6/1993

(Continued)

*Primary Examiner* — Abdullah A Riyami
*Assistant Examiner* — Nelson R. Burgos-Guntin
(74) *Attorney, Agent, or Firm* — Robert P. Michal, Esq.; Carter, DeLuca & Farrell LLP

(57) ABSTRACT

An electronic device includes: a conductive casing accommodating a circuit board; a connector including a connection surface having formed therein a plurality of connection holes into which a plurality of conducting wires are inserted, the connector being provided for a surface of the casing to connect the plurality of conducting wires and the circuit board; and a conductive, conducting member provided so as to cover at least part of the connection surface except the connection holes and connected to the casing.

6 Claims, 6 Drawing Sheets

(56) References Cited

U.S. PATENT DOCUMENTS

| | | | | |
|---|---|---|---|---|
| 2014/0364016 | A1* | 12/2014 | Ozawa | H01R 4/301 439/737 |
| 2015/0011126 | A1* | 1/2015 | Zhou | H01R 13/646 439/620.21 |
| 2016/0028170 | A1* | 1/2016 | Hyder | H01R 9/2416 439/462 |
| 2016/0197417 | A1* | 7/2016 | Busbee | B33Y 80/00 439/38 |
| 2016/0204526 | A1* | 7/2016 | Wu | H01R 4/4809 439/816 |
| 2017/0141491 | A1* | 5/2017 | Daily | H01R 12/716 |
| 2020/0028286 | A1* | 1/2020 | Yoshida | H01R 12/515 |

FOREIGN PATENT DOCUMENTS

| | | | |
|---|---|---|---|
| JP | H05-205827 | A | 8/1993 |
| JP | H09-017470 | A | 1/1997 |
| JP | 2004208350 | A | 7/2004 |
| JP | 2004-247066 | A | 9/2004 |
| JP | 2017-112229 | A | 6/2017 |

* cited by examiner

ELECTRONIC DEVICE

CROSS-REFERENCE TO RELATED APPLICATION

This application is based upon and claims the benefit of priority from Japanese Patent Application No. 2018-136461 filed on Jul. 20, 2018, the contents of which are incorporated herein by reference.

BACKGROUND OF THE INVENTION

Field of the Invention

The present invention relates to an electronic device.

Description of the Related Art

Some electronic devices are configured to be capable of electrically connecting a conducting wire (conductive wire material) and a circuit board within a casing through a connector provided for a surface of the casing (Japanese Laid-Open Utility Model Publication No. 59-025166).

SUMMARY OF THE INVENTION

With the electronic device cited above, when an operator's hand comes close to the connector to which the conducting wire is connected, for example, static electricity from the charged operator may flow to the conducting wire. The static electricity flowing in the conducting wire may damage the circuit board in the casing that is connected to the conducting wire through the connector.

Accordingly, an object of the present invention is to provide an electronic device that, even when an operator comes close to a connector to which a conducting wire is connected, can prevent the static electricity originating from the operator from flowing to the conducting wire and to the inside of the casing.

According to an aspect of the present invention, an electronic device includes: a circuit board; a conductive casing accommodating the circuit board; a connector including a connection surface having formed therein a plurality of connection holes into which a plurality of conducting wires are inserted, the connector being provided for a surface of the casing to connect the plurality of conducting wires and the circuit board; and a conductive, conducting member provided so as to cover at least part of the connection surface except the connection holes and connected to the casing.

According to the present invention, even when a charged operator comes close to the connector, the static electricity of the operator flows not to the conducting wires but to the conducting member. Thus, even when the operator comes close to the connector to which the conducting wires are connected, it is possible to prevent the static electricity originating from the operator from flowing to the conducting wires and to the inside of the casing.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

The electronic device according to the present invention will now be described in detail in conjunction with preferred embodiments while referring to the accompanying drawings.

First Embodiment

Figure 1:
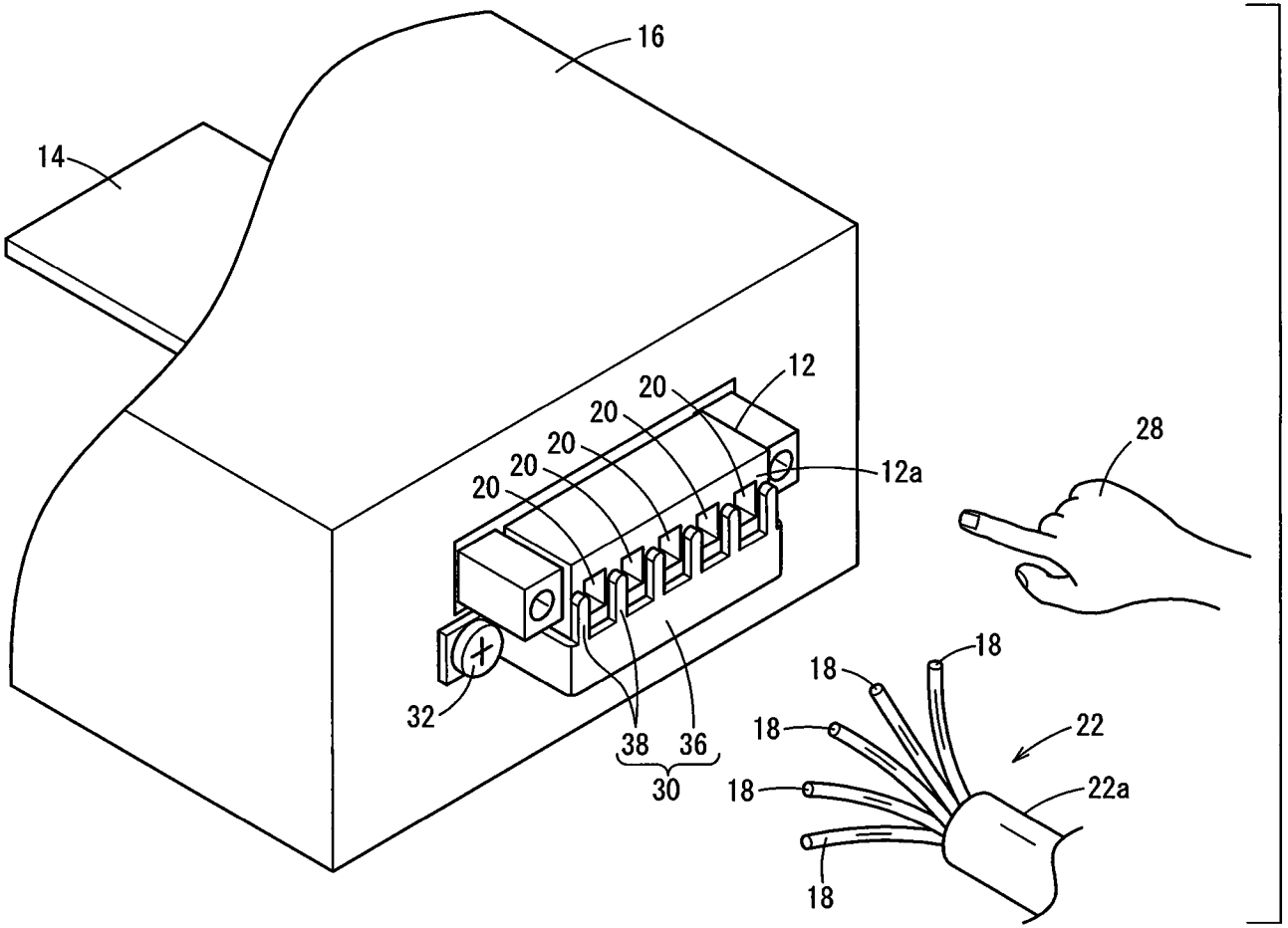
FIG. 1 is a perspective view showing the configuration of an electronic device according to a first embodiment.
Figure 2:
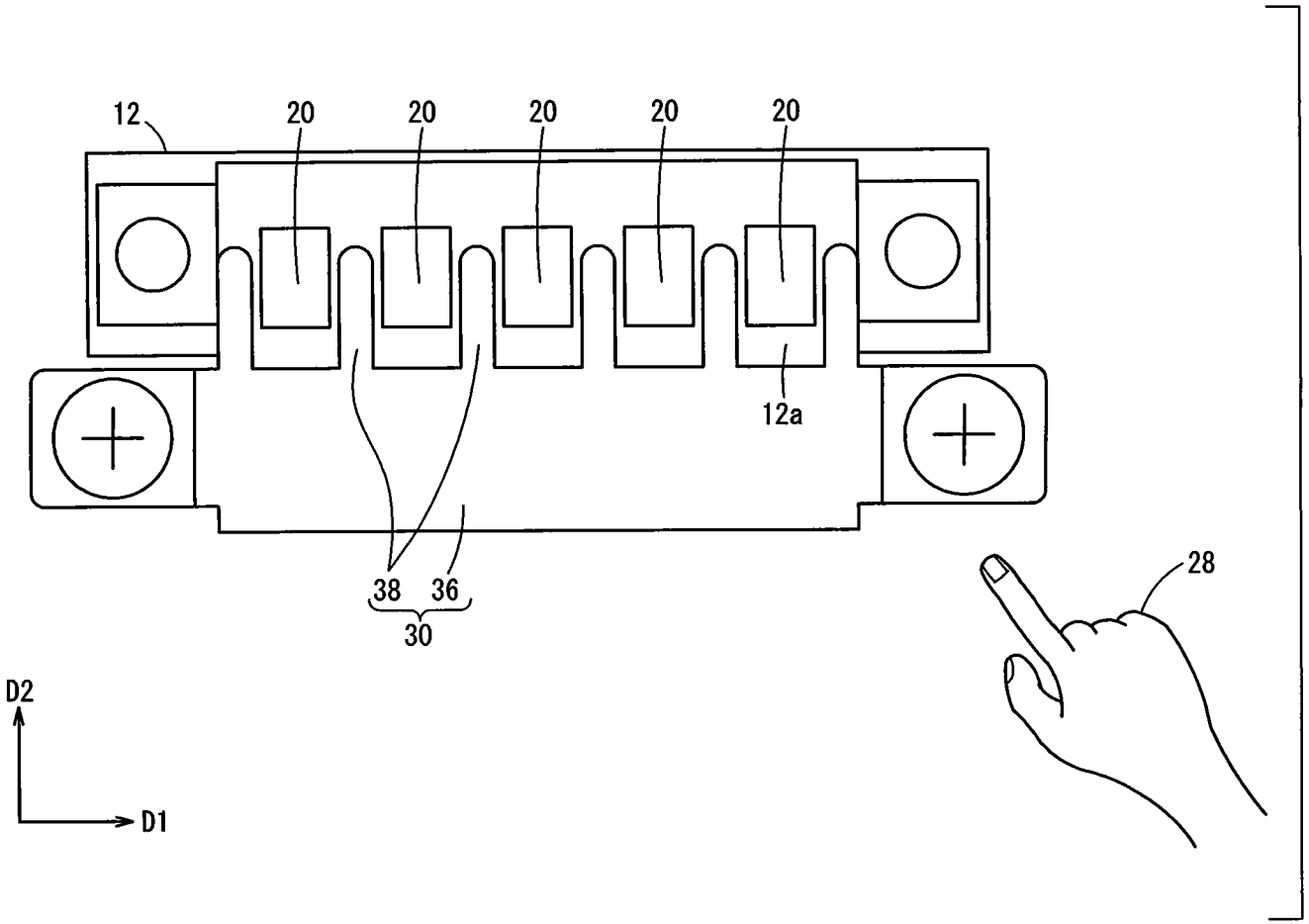
FIG. 2 is a plan view showing a connector of the first embodiment seen from the side of a connection surface thereof.

FIG. 1 is a perspective view showing the configuration of an electronic device 10 according to a first embodiment. FIG. 2 is a plan view showing a connector 12 of the first embodiment seen from the side of a connection surface 12*a* thereof.

The electronic device 10 includes a circuit board 14 and a conductive casing 16 accommodating the circuit board 14. The electronic device 10 further includes the connector 12 provided for a surface of the casing 16.

The connector 12 includes the connection surface 12*a* having formed therein a plurality of connection holes 20 into which a plurality of conducting wires 18 are inserted, and thereby connects the plurality of conducting wires 18 and the circuit board 14. As shown in FIG. 2, the plurality of connection holes 20 are formed in line along a predetermined direction D1. Although the example of FIGS. 1 and 2 has five conducting wires 18 and five connection holes 20, the conducting wires 18 and the connection holes 20 may be provided more than or less than five.

In this embodiment, the circuit board 14 accommodated in the casing 16 is a printed circuit board having a given conductor pattern and electronic components. The casing 16 is grounded in this embodiment.

Further, in this embodiment, the plurality of conducting wires 18 are coated together by a shield member 22*a* to form a single cable 22. Note that part of the shield member 22*a* located near the connection holes 20 is removed beforehand so as not to hinder the connection between the conducting wires 18 and the connector 12.

Figure 3:
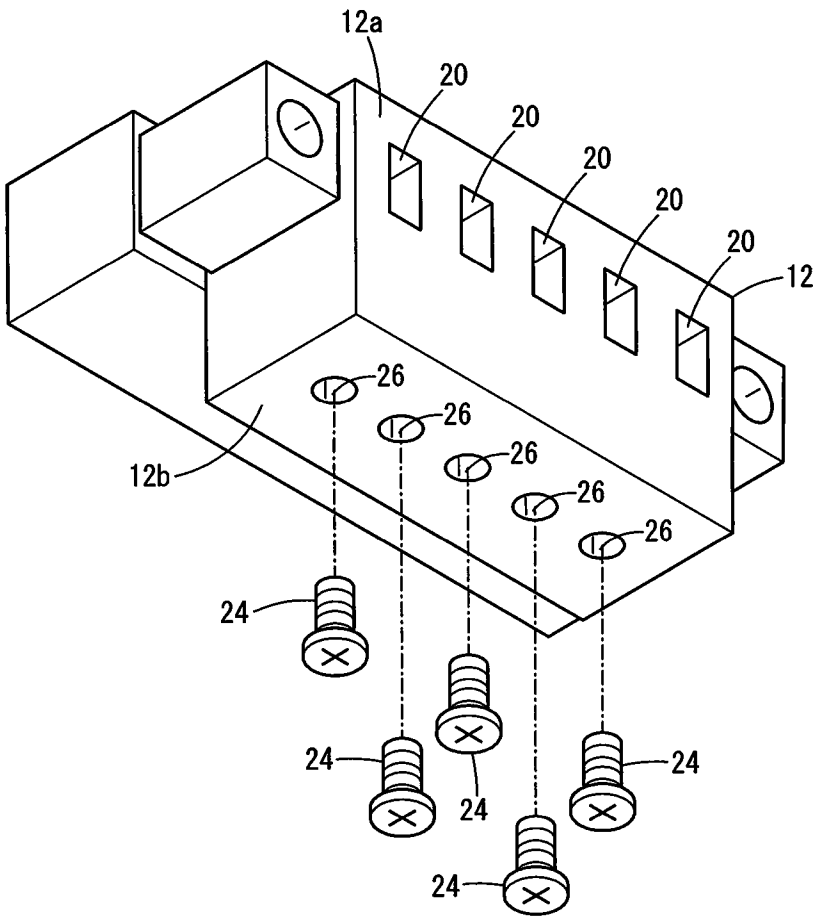
FIG. 3 is a perspective view showing the connector of the first embodiment seen from the side of an operational surface thereof, where a conducting member is omitted.

FIG. 3 is a perspective view showing the connector 12 of the first embodiment seen from the side of an operational surface 12*b* thereof, where the conducting member 30 is omitted.

Now, a mechanism for connecting the connector 12 and the conducting wires 18 will be described briefly. In this embodiment, the connector 12 is a crimped-on connector. That is, the connector 12 includes a plurality of screws 24 and a clamp mechanism (not shown) that fixes the conducting wires 18 inserted in the plurality of connection holes 20 with the plurality of screws 24 being tightened. The connector 12 further has the operational surface 12*b* that is a different surface from the connection surface 12*a*. The operational surface 12*b* has formed therein a plurality of operation holes 26 allowing an operator to adjust turning of each of the plurality of screws 24 to control the tightening of the conducting wires 18. The plurality of screws 24 and the plurality of operation holes 26 are provided corresponding respectively to the plurality of connection holes 20. Like the number of the connection holes 20, the numbers of the screws 24 and the operation holes 26 are not limited to five. The crimped-on connector 12 has been explained merely as an example, and the type of connectors used in this embodiment is not limited to the crimped-on type.

When the connector 12 and conducting wires 18 constructed as shown above are connected, an operator inserts the plurality of conducting wires 18 respectively into the plurality of connection holes 20 and tightens the screws 24 through the operation holes 26. The conducting wires 18 are thus fixed in the connection holes 20, whereby the connector 12 and the conducting wires 18 are connected.

In the state where the conducting wires 18 and the connector 12 are connected as described above, the conducting wires 18 are not protected near the connection holes 20 by the shield member 22*a*. In this state, if a hand 28 (electric conductor) of the operator that has been charged with static electricity comes close to the connector 12, it is possible that the static electricity flows from the operator's hand 28 to the conducting wires 18. If the static electricity flows to the circuit board 14 in the casing 16 through the conducting wires 18 and the connector 12, it may cause problems such as damage to the circuit board 14. Accordingly, in this embodiment, as shown in FIGS. 1 and 2, the conductive conducting member 30 is provided in order to prevent the static electricity from flowing to the conducting wires 18 and to the inside of the casing 16.

As shown in FIGS. 1 and 2, the conducting member 30 includes a sheet metal 36 that extends along the predetermined direction D1 such that the sheet metal 36 covers at least part of the outer circumference of the connector 12. Further, the conducting member 30 includes a plurality of protruding portions 38 protruding from the sheet metal 36 in a direction D2 toward the connection holes 20 (a direction crossing the predetermined direction D1). Also, at least one of the plurality of protruding portions 38 is located between two adjacent connection holes 20. In this case, as shown in FIG. 2, it is preferred that the direction D1 and the direction D2 be orthogonal to each other. Further, as shown in FIG. 2, it is preferred that the protruding portions 38 be located between all adjacent connection holes 20.

Figure 4:
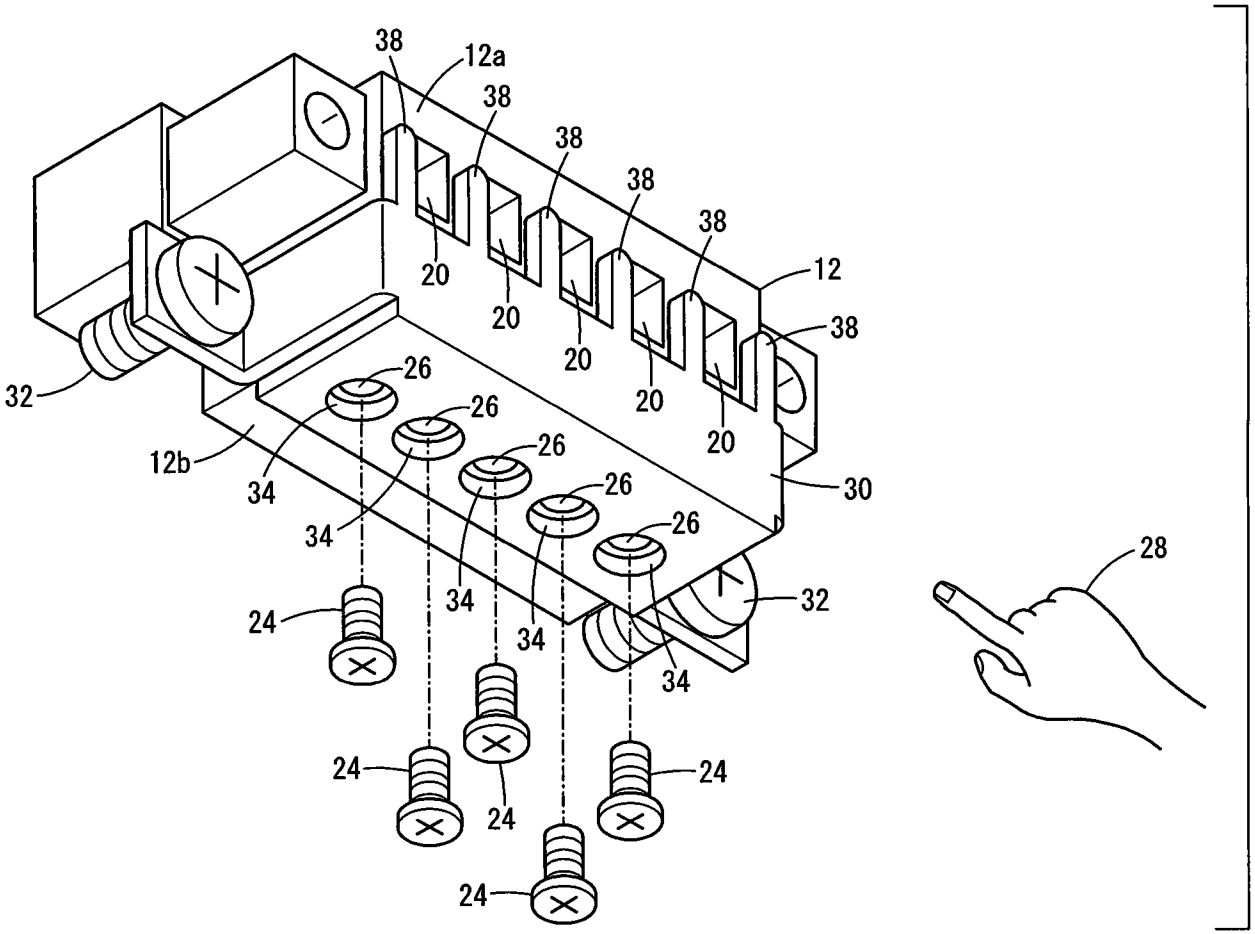
FIG. 4 is a perspective view showing the connector of the first embodiment seen from the side of the operational surface.

FIG. 4 is a perspective view showing the connector 12 of the first embodiment seen from the side of the operational surface 12*b*.

As shown in FIG. 4, the conducting member 30 covers not only part of the connection surface 12*a* but also the operational surface 12*b* of the connector 12. In this case, as shown in FIG. 4, a plurality of holes 34 for exposing the plurality of operation holes 26 are formed in portions of the operational surface 12*b* side of the conducting member 30 so that the conducting member 30 does not hinder the work of tightening the screws 24.

The conducting member 30 above is disposed to cover at least part of the connection surface 12*a* except the connection holes 20 and is connected to the casing 16. Therefore, the conducting member 30 connected to the grounded casing 16 is also grounded. Further, in this embodiment, the conducting member 30 is fixed to the casing 16 by fastening members 32. As long as the conducting member 30 is electrically connected with the casing 16, the conducting member 30 need not necessarily be fixed to the casing 16 but may be fixed to another part. For example, the conducting member 30 may be fixed to the connector 12, with part of the conducting member 30 being in contact with the casing 16.

In this embodiment, when an operator's hand 28 charged with static electricity comes close the connector 12, the conducting member 30 covering the connector 12 is likely to come in contact with the operator's hand 28. Then, the static electricity stored on the operator's hand 28 flows not to the conducting wires 18 but to the conducting member 30.

Furthermore, in this embodiment, the conducting member 30 has the plurality of protruding portions 38 and therefore the static electricity stored on the operator's hand 28 is more likely to flow to the conducting member 30. That is, since static electricity has the property of being more likely to flow to a protruding portion than to a flat portion, the static electricity stored on the operator's hand 28 tends to flow not to the conducting wires 18 but to the conducting member 30 because of the presence of the protruding portions 38. Although there is no limitation on how many protruding portions 38 should be provided, the operator's hand 28 is more likely to come close to the conducting member 30 when a plurality of protruding portions 38 are provided than when a single protruding portion 38 is provided.

Static electricity may flow even through air between neighboring two conductive objects. This is more likely to occur when at least one of the neighboring two objects has a protruding portion. In this embodiment, since the conducting member 30 has the protruding portions 38, static electricity stored on the operator's hand 28 is likely to flow to the conducting member 30 even when the operator's hand 28 does not come in direct contact with the conducting member 30.

In this embodiment, the protruding portions 38 protrude in the direction D2 toward the connection holes 20 (a direction crossing the predetermined direction D1). Accordingly, in this embodiment, when the operator's hand 28 comes close to the connector 12, especially close to a connection hole 20 of the connector 12 (a conducting wire 18), the operator's hand 28 comes close to the distal end of the protruding portion 38. Static electricity stored on the operator's hand 28 is hence likely to flow to the conducting member 30.

In this embodiment, the conducting member 30 has at least one protruding portion 38 located between two adjacent connection holes 20. Accordingly, in this embodiment, when the operator's hand 28 comes close to one of the two adjacent connection holes 20, then the operator's hand 28 comes close to the distal end of the protruding portion 38 located between the two connection holes 20. Static electricity stored on the operator's hand 28 is thus likely to flow to the conducting member 30.

As has been described so far, according to this embodiment, even if the operator's hand 28 comes close to the connector 12 to which the conducting wires 18 are connected, it is possible to suppress the flow of static electricity originating from the operator's hand 28 to the conducting wires 18 and to the inside of the casing 16.

Modifications

The first embodiment has been described as an example of the present invention but various modifications or improvements can of course be applied to the first embodiment. It is clear from the recitation of claims that embodiments to which such various modifications or improvements are applied are also included within the technical scope of the present invention.

First Modification

Figure 5:
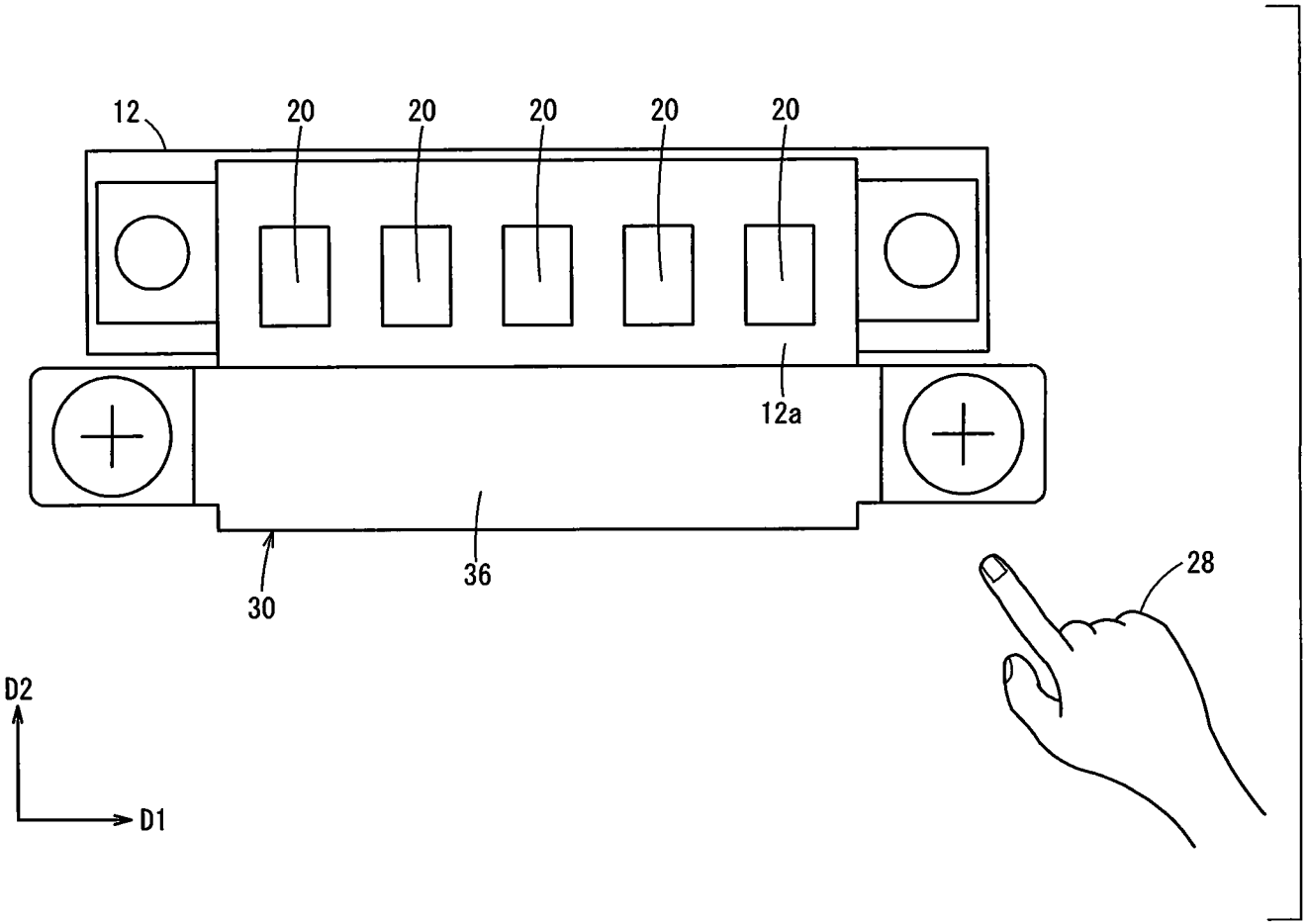
FIG. 5 is a plan view showing a connector according to a first modification seen from the side of its connection surface.

FIG. 5 is a plan view showing a connector 12 according to a first modification seen from the side of its connection surface 12*a*.

As shown in FIG. 5, the protruding portions 38 of the conducting member 30 may be omitted. Omitting the protruding portions 38 simplifies the structure. Even when the protruding portions 38 are omitted, it is possible, when the operator's hand 28 comes close to the connector 12, to cause the static electricity stored on the operator's hand 28 to flow not to the conducting wires 18 but to the conducting member 30. It is thus possible to suppress the flow of static electricity originating from the operator's hand 28 to the conducting wires 18 and the inside of the casing 16 even when the operator's hand 28 comes close to the connector 12.

Second Modification

Figure 6:
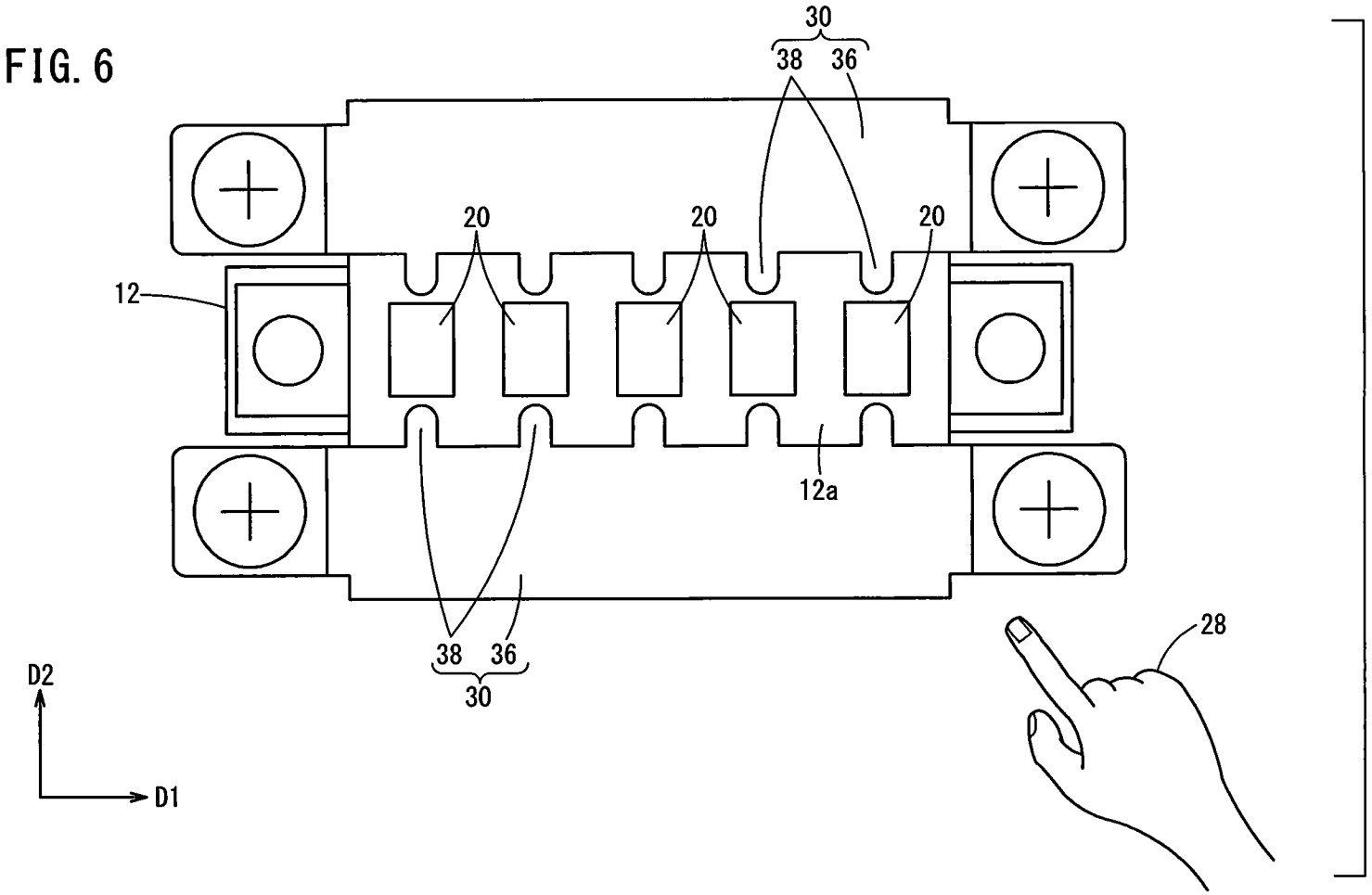
FIG. 6 is a plan view showing a connector according to a second modification seen from the side of its connection surface.

FIG. 6 is a plan view showing a connector 12 according to a second modification seen from the side of its connection surface 12*a*.

As shown in FIG. 6, protruding portions 38 may protrude such that the distal ends of the protruding portions 38 are directed to the connection holes 20. Then, when the operator's hand 28 comes close to a connection hole 20 to which the distal ends of protruding portions 38 are directed, the operator's hand 28 tends to come close to the distal ends of the protruding portion 38, whereby the static electricity stored on the operator's hand 28 tends to flow to the conducting member 30.

In the example of FIG. 6, the conducting members 30 are provided in two portions—on an upper side and a lower side in the drawing—of the connection holes 20. In this way, a plurality of conducting members 30 may be provided. The operator's hand 28 then tends to come close to the conducting members 30 and thus the static electricity stored on the operator's hand 28 more tends to flow to the conducting members 30.

Third Modification

The embodiments and modifications shown above may be combined together in any way within a range where no contradiction occurs.

Technical Ideas Obtained from Embodiments

Technical ideas that can be grasped from the embodiments and modifications above will be recited below.

An electronic device (10) includes: a circuit board (14); a conductive casing (16) accommodating the circuit board (14); a connector (12) including a connection surface (12*a*) having formed therein a plurality of connection holes (20) into which a plurality of conducting wires (18) are inserted, the connector (12) being provided for a surface of the casing (16) to connect the plurality of conducting wires (18) and the circuit board (14); and a conductive, conducting member (30) provided so as to cover at least part of the connection surface (12*a*) except the connection holes (20) and connected to the casing (16).

Then, even if an operator's hand (28) comes close to the connector (12) to which the conducting wires (18) are connected, the static electricity originating from the operator's hand (28) is prevented from flowing to the conducting wires (18) and to the inside of the casing (16).

The conducting member (30) may include: a sheet metal (36) covering at least part of an exterior of the connector (12); and a protruding portion (38) protruding from the sheet metal (36) toward the connection holes (20). Then, for example, static electricity stored on the operator's hand (28) is more likely to flow not to the conducting wires (18) but to the conducting member (30). Furthermore, even when the operator's hand (28) does not directly touch the conducting member (30), the static electricity of the operator's hand (28) can be caused to flow not to the conducting wires (18) but to the conducting member (30).

The plurality of connection holes (20) may be arranged along a predetermined direction (D1) in the connection surface (12*a*), the sheet metal (36) may extend along the predetermined direction (D1), and the protruding portion (38) may protrude in a direction (D2) crossing the predetermined direction (D1). Thus, for example, it is possible to locate the conducting member (30) near all of the plurality of connection holes (20).

The conducting member (30) may include a plurality of the protruding portions (38). Thus, for example, as compared to a case where a single protruding portion (38) is provided, static electricity originating from the operator's hand (28) is further probably prevented from flowing to the conducting wires (18) and to the inside of the casing (16).

At least one of the plurality of protruding portions (38) may be positioned between two of the connection holes (20) that are adjacent to each other. Thus, for example, when the operator's hand (28) comes close to either of the two adjacent connection holes (20), the operator's hand (28) comes close to the protruding portion (38). Static electricity originating from the operator's hand (28) is thus further likely to be prevented from flowing to the conducting wires (18) and to the inside of the casing (16).

The connector (12) may include: a plurality of screws (24); a clamp mechanism configured to fix the conducting wires (18) inserted in the plurality of connection holes (20) by tightening of the plurality of screws (24); and an operational surface (12*b*) that is a surface different from the connection surface (12*a*) and in which a plurality of operation holes (26) are formed to allow an operator to adjust turning of each of the plurality of screws (24) to control the tightening of the conducting wires (18), and the conducting member (30) may cover the operational surface (12*b*) and have formed therein a plurality of holes (34) for exposing the plurality of operation holes (26). Thus, for example, the conducting member (30) can be present also in the operational surface (12*b*) without hindering the work of tightening the screws (24).

What is claimed is:

1. An electronic device comprising:

a circuit board;

a conductive casing accommodating the circuit board;

a connector including a connection surface having formed therein a plurality of connection holes into which a plurality of conducting wires are inserted, the connector being provided for a surface of the casing to connect the plurality of conducting wires and the circuit board; and a conductive, conducting member provided so as to cover at least part of the connection surface except the connection holes and connected to the casing.

2. The electronic device according to claim 1, wherein the conducting member comprises:

a sheet metal covering at least part of an exterior of the connector; and a protruding portion protruding from the sheet metal toward the connection holes.

3. The electronic device according to claim 2, wherein the plurality of connection holes are arranged along a predetermined direction in the connection surface, the sheet metal extends along the predetermined direction, and the protruding portion protrudes in a direction crossing the predetermined direction.

4. The electronic device according to claim 2, wherein the conducting member includes a plurality of the protruding portions.

5. The electronic device according to claim 4, wherein at least one of the plurality of protruding portions is positioned between two of the connection holes that are adjacent to each other.

6. The electronic device according to claim 1, wherein the connector comprises:

a plurality of screws;

a clamp mechanism configured to fix the conducting wires inserted in the plurality of connection holes by tightening of the plurality of screws; and an operational surface that is a surface different from the connection surface and in which a plurality of operation holes are formed to allow an operator to adjust turning of each of the plurality of screws to control the tightening of the conducting wires, wherein the conducting member covers the operational surface and has formed therein a plurality of holes for exposing the plurality of operation holes.

* * * * *